US012599235B2

(12) United States Patent
Ye et al.

(10) Patent No.: US 12,599,235 B2
(45) Date of Patent: Apr. 14, 2026

(54) MECHANICAL EXTENSION DEVICE AND SUSPENSION MECHANISM THEREOF

(71) Applicant: DEWERTOKIN TECHNOLOGY GROUP CO., LTD., Zhejiang (CN)

(72) Inventors: Qiqi Ye, Zhejiang (CN); Liming Yang, Zhejiang (CN); Weiyao Zhou, Zhejiang (CN); Bin Shen, Zhejiang (CN); Kangming Tao, Zhejiang (CN)

(73) Assignee: DEWERTOKIN TECHNOLOGY GROUP CO., LTD., Jiaxing (CN)

( * ) Notice: Subject to any disclaimer, the term of this patent is extended or adjusted under 35 U.S.C. 154(b) by 204 days.

(21) Appl. No.: 18/292,400

(22) PCT Filed: Aug. 17, 2022

(86) PCT No.: PCT/CN2022/112900

§ 371 (c)(1),
(2) Date: Jan. 26, 2024

(87) PCT Pub. No.: WO2023/020514

PCT Pub. Date: Feb. 23, 2023

(65) Prior Publication Data

US 2025/0082099 A1 Mar. 13, 2025

(30) Foreign Application Priority Data

Aug. 17, 2021 (CN) ..... 202110940890.4
Aug. 17, 2021 (CN) ..... 202110940906.1
(Continued)

(51) Int. Cl.
*A47C 1/0355* (2013.01)
*A47C 7/46* (2006.01)

(52) U.S. Cl.
CPC ..... *A47C 1/0355* (2013.01); *A47C 7/462* (2013.01)

(58) Field of Classification Search
CPC ... A47C 1/0355; A47C 7/462; A47C 1/03211; A47C 1/03205
See application file for complete search history.

(56) References Cited

U.S. PATENT DOCUMENTS 2,567,612 A * 9/1951 Mcgehee ..... A47C 3/0255 248/370
5,772,278 A * 6/1998 Kowalski ..... A47C 1/0355 297/85 L
(Continued)

FOREIGN PATENT DOCUMENTS

CN 107660913 2/2018
CN 208957347 U 6/2019
(Continued)

OTHER PUBLICATIONS

Search Report for CN2021109409061 (Dec. 27, 2024).
(Continued)

*Primary Examiner* — Medhat Badawi

(57) ABSTRACT

A suspension mechanism is configured to be mounted on a mounting plate of the mechanical extension device and includes a link structure connected to the mounting plate and including a first link, a second link, and a third link, where a first end of the first link is hinged to the mounting plate, and a second end of the first link is hinged to the third link; a first end of the second link is hinged to the mounting plate, and a second end of the second link is hinged to the third link; and the first link, the second link, the third link, and the mounting plate constitute a first four-bar structure; and a control structure connected to the link structure

16 Claims, 9 Drawing Sheets

(30) Foreign Application Priority Data

Aug. 17, 2021 (CN) ..... 202121921433.2
Aug. 17, 2021 (CN) ..... 202121921465.2

(56) References Cited

U.S. PATENT DOCUMENTS 11,478,083 B1* 10/2022 Li ..... A47C 17/04
11,564,496 B1* 1/2023 Li ..... A47C 1/0355
2013/0011335 A1* 1/2013 Xie ..... G01N 33/5008 514/19.5
2016/0045031 A1* 2/2016 Lawson ..... A47C 7/506 297/284.3
2018/0027968 A1* 2/2018 Lawson ..... A47C 1/0355
2018/0103761 A1* 4/2018 White ..... A47C 1/0352
2020/0100593 A1* 4/2020 He ..... A47C 7/38
2020/0100596 A1* 4/2020 He ..... A47C 17/00
2023/0068014 A1* 3/2023 Sun ..... A47C 1/03211
2023/0200536 A1* 6/2023 Beech ..... A47C 31/008 297/463.1
2023/0380597 A1* 11/2023 Li ..... A47C 1/0355
2024/0023713 A1* 1/2024 Murphy ..... A47C 1/0345
2024/0122346 A1* 4/2024 Murphy ..... A47C 1/0355
2024/0138568 A1* 5/2024 Yang ..... A47C 1/0355
2024/0138577 A1* 5/2024 Yang ..... A47C 1/03211
2024/0148144 A1* 5/2024 Li ..... A47C 7/5066
2024/0148145 A1* 5/2024 Li ..... A47C 1/0355
2024/0156262 A1* 5/2024 Li ..... A47C 1/0355
2024/0156263 A1* 5/2024 Li ..... A47C 1/0347
2024/0164527 A1* 5/2024 Li ..... A47C 7/5068
2024/0215726 A1* 7/2024 Li ..... A47C 1/0345
2024/0277145 A1* 8/2024 Li ..... A61G 5/14
2024/0298805 A1* 9/2024 Li ..... A47C 7/5062
2024/0335039 A1* 10/2024 Lake ..... A47C 1/0355
2024/0335042 A1* 10/2024 Liu ..... A47C 1/024
2024/0341478 A1* 10/2024 Zhao ..... A47C 3/03
2024/0341479 A1* 10/2024 Murphy ..... A47C 1/0355
2024/0365979 A1* 11/2024 Lawson ..... A47C 1/0355
2024/0374031 A1* 11/2024 Tan ..... A47C 1/0355
2024/0374032 A1* 11/2024 Sun ..... A47C 1/0355
2024/0389751 A1* 11/2024 Sun ..... A47C 1/03211
2024/0423369 A1* 12/2024 Loccioni ..... A47C 1/0342
2025/0000260 A1* 1/2025 Cai ..... A47C 1/0355
2025/0040708 A1* 2/2025 Lake ..... A47C 1/0345
2025/0040709 A1* 2/2025 Lake ..... A47C 1/0355
2025/0057317 A1* 2/2025 Zhou ..... A47C 17/86
2025/0072612 A1* 3/2025 Zhao ..... A47C 1/03211
2025/0082099 A1* 3/2025 Ye ..... A47C 1/03211
2025/0107624 A1* 4/2025 Dick ..... A47C 4/00
2025/0151906 A1* 5/2025 Yang ..... A47C 1/0355
2025/0151908 A1* 5/2025 Lei ..... A47C 1/0355
2025/0160520 A1* 5/2025 Cai ..... A47C 1/0345
2025/0160521 A1* 5/2025 Cai ..... A47C 1/0345
2025/0261757 A1* 8/2025 Crum ..... A47C 1/0355
2025/0280955 A1* 9/2025 Murphy ..... A47C 15/004
2025/0295236 A1* 9/2025 Johnson ..... A47C 7/563

FOREIGN PATENT DOCUMENTS

CN 111297113 A 6/2020
CN 111759121 A 10/2020
CN 211795449 U 10/2020
CN 212489259 U 2/2021
CN 212521294 2/2021
CN 212754927 U 3/2021
CN 112741445 5/2021
CN 113040555 A 6/2021
CN 213308542 U 6/2021
CN 113142880 A 7/2021
CN 113475885 A 10/2021
CN 113475898 A 10/2021
CN 215533016 U 1/2022
CN 215533081 U 1/2022

OTHER PUBLICATIONS

Search Report for CN2021109408904 (Nov. 15, 2024).
ISR for PCT/CN2022/112900 (Nov. 10, 2022) (6 pages).
Search Report for EPO 22857825.8 (Jun. 25, 2025).
Search Report for EPO 25151920.3 (Jun. 25, 2025).

* cited by examiner

MECHANICAL EXTENSION DEVICE AND SUSPENSION MECHANISM THEREOF

CROSS-REFERENCE TO RELATED APPLICATION(S)

This is a national stage application filed under 37 U.S.C. 371 based on International Patent Application No. PCT/CN2022/112900, filed Aug. 17, 2022, which claims priority to Chinese Patent Application No. 202121921433.2 filed Aug. 17, 2021, Chinese Patent Application No. 202110940890.4 filed Aug. 17, 2021, Chinese Patent Application No. 202110940906.1 filed Aug. 17, 2021, and Chinese Patent Application No. 202121921465.2 filed Aug. 17, 2021, the disclosures of which are incorporated herein by reference in their entireties.

TECHNICAL FIELD

The present application relates to a mechanical extension device and a suspension mechanism thereof.

BACKGROUND

In the related art, a sofa, seat, or wheelchair can be adjusted through an electric or manual mechanical extension device that is generally installed inside so that the sofa, seat, or wheelchair can be switched between different states. A mechanical extension device for a floor sofa with armrests in the related art includes a seat unit, a leg unit, a backrest unit, a link structure, and a drive unit, where the drive unit controls the extension of the leg unit and the angle adjustment of the backrest unit. The mechanical extension device for the floor sofa with armrests in the related art has the following disadvantages: the mating of the leg unit and the link structure with the seat unit is unreasonably designed, which leads to a relatively high overall height of the mechanical extension device and is not conducive to size control; connecting components are installed on the seat unit to install a wooden frame, but the connecting components are relatively complicated in structure; to reduce a sitting height, the wooden frame is sunk and installed on the inner side of a mounting plate of the seat unit, and a certain interstice exists between the wooden frame and the inner side of the mounting plate, which is prone to dust accumulation and damage and causes poor stability; the structural design of the link structure is unreasonable, resulting in unsmooth operation and affecting user experience, and the link structure has the problem of low structural strength; and the backrest unit has relatively low structural strength and is likely to be easily damaged during use.

SUMMARY

The present application provides a mechanical extension device and a suspension mechanism thereof, which can solve the technical problem in the related art of an unreasonable structural design of a link structure, resulting in unsmooth operation and affecting user experience.

An embodiment provides a suspension mechanism. The suspension mechanism includes a link structure and a control structure. The link structure is configured to connect to a mounting plate and includes a first link, a second link, and a third link, where a first end of the first link is configured to hinge to the mounting plate, and a second end of the first link hinges to the third link; a first end of the second link is configured to hinge to the mounting plate, and a second end of the second link hinges to the third link; and the first link, the second link, the third link, and the mounting plate are configured to constitute a first four-bar structure; and the control structure connects to the link structure and include a first control link, a second control link, a third control link, and a fourth control link; where a first end of the second control link hinges to the first control link, and a second end of the second control link hinges to the third control link: a first end of the fourth control link hinges to the first control link, and a second end of the fourth control link hinges to the third control link; and the first control link, the second control link, the third control link, and the fourth control link constitute a second four-bar structure.

An embodiment of the present application provides a mechanical extension device including the preceding suspension mechanism and a seat unit, where the seat unit includes the mounting plate and a mounting plane, and the mounting plate is configured for mounting the suspension mechanism.

An embodiment of the present application provides another mechanical extension device. The mechanical extension device includes a seat unit including a mounting plate, where the mounting plate is configured with a mounting plane and has a first rivet point, a second rivet point, a third rivet point, and a fourth rivet point; a link structure configured to connect to the mounting plate through the first rivet point and the second rivet point on the mounting plate; and a leg unit configured to connect to the mounting plate through the third rivet point and the fourth rivet point on the mounting plate; where the first rivet point, the second rivet point, and the third rivet point are each below the mounting plane; and a vertical distance between the center of the fourth rivet point and an extension line of the mounting plane of the mounting plate is not greater than 10 mm.

REFERENCE LIST

Figure 1:
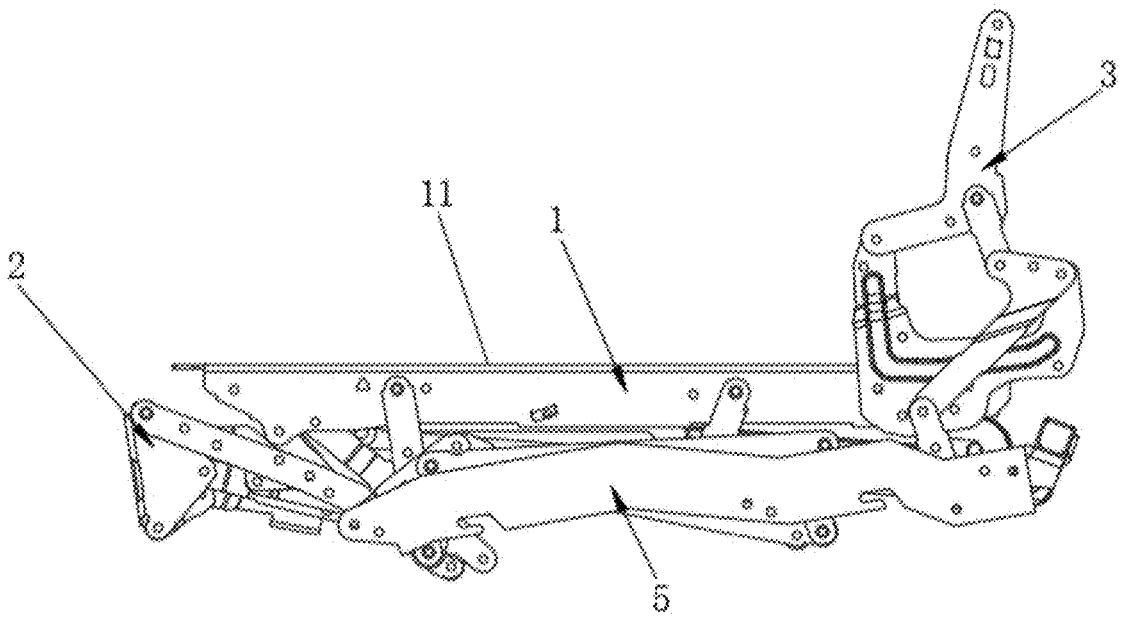
FIG. 1 is a front view of a mechanical extension device in embodiment one of the present application, which shows that the mechanical extension device is in a state for a sitting posture.

1 seat unit
11 mounting plate
2 leg unit
21 first leg adjustment rod
22 second leg adjustment rod
23 third leg adjustment rod
231 first hinge point
232 second hinge point
233 third hinge point
24 fourth leg adjustment rod
25 fifth leg adjustment rod
26 sixth leg adjustment rod
27 seventh leg adjustment rod
28 linkage adjustment rod
281 first portion
282 second portion
3 backrest unit
31 fixed plate
311 body portion
312 first support arm
313 second support arm
314 stiffener
32 first backrest adjustment rod
321 mounting portion
33 second backrest adjustment rod
34 third backrest adjustment rod
341 first arm
342 second arm
35 fourth backrest adjustment rod
4 link structure
41 first link
42 second link
43 third link
5 control structure
51 first control link
52 second control link
53 third control link
54 fourth control link
55 fifth control link
56 sixth control link
57 seventh control link
6 drive unit
61 first bracket
62 second bracket
63 telescopic unit

DETAILED DESCRIPTION

Embodiment One

Referring to FIGS. 1 to 8, a mechanical extension device in this embodiment is applicable to a sofa, seat, or wheelchair, and the mechanical extension device includes a seat unit 1, a leg unit 2, a backrest unit 3, a link structure 4, a control structure 5, and a drive unit 6. The link structure 4 and the control structure 5 form a suspension mechanism for the mechanical extension device, and the suspension mechanism is mounted on the seat unit 1 of the mechanical extension device.

The seat unit 1 in this embodiment includes a mounting plate 11. An upper plane of the mounting plate 11 is configured for mounting a soft part for sitting. The suspension mechanism is mounted on the mounting plate 11.

Figure 6:
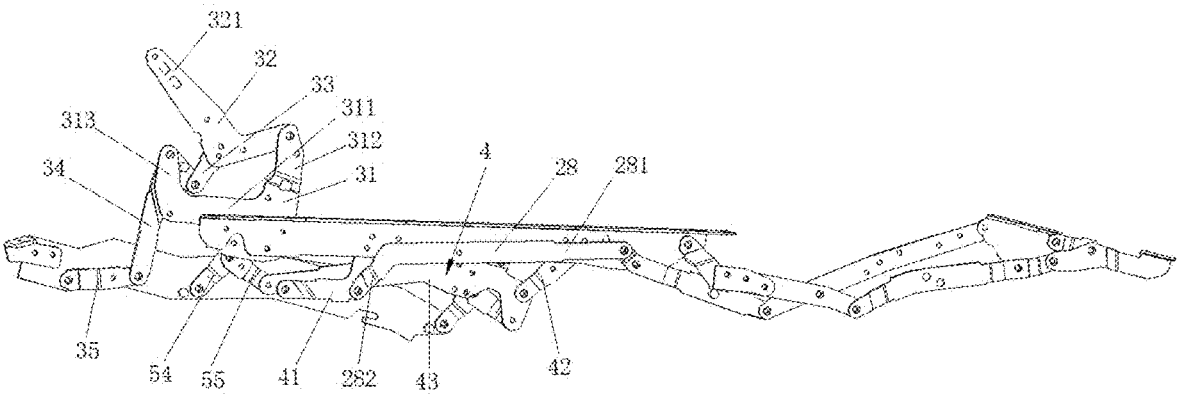
FIG. 6 is schematic one of the mating between a seat unit, a leg unit, a backrest unit, a link structure, and a control structure, which shows that a mechanical extension device is in a state for a lying posture.
Figure 7:
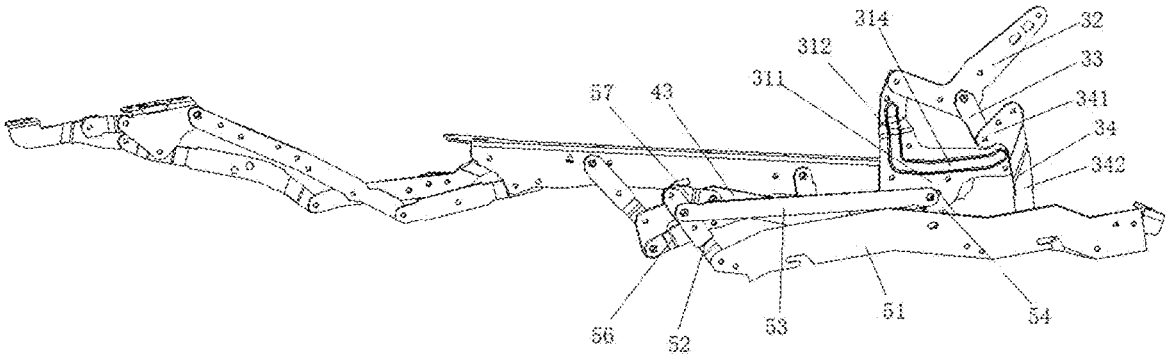
FIG. 7 is schematic two of the mating between a seat unit, a leg unit, a backrest unit, a link structure, and a control structure, which shows that a mechanical extension device is in a state for a lying posture.
Figure 8:
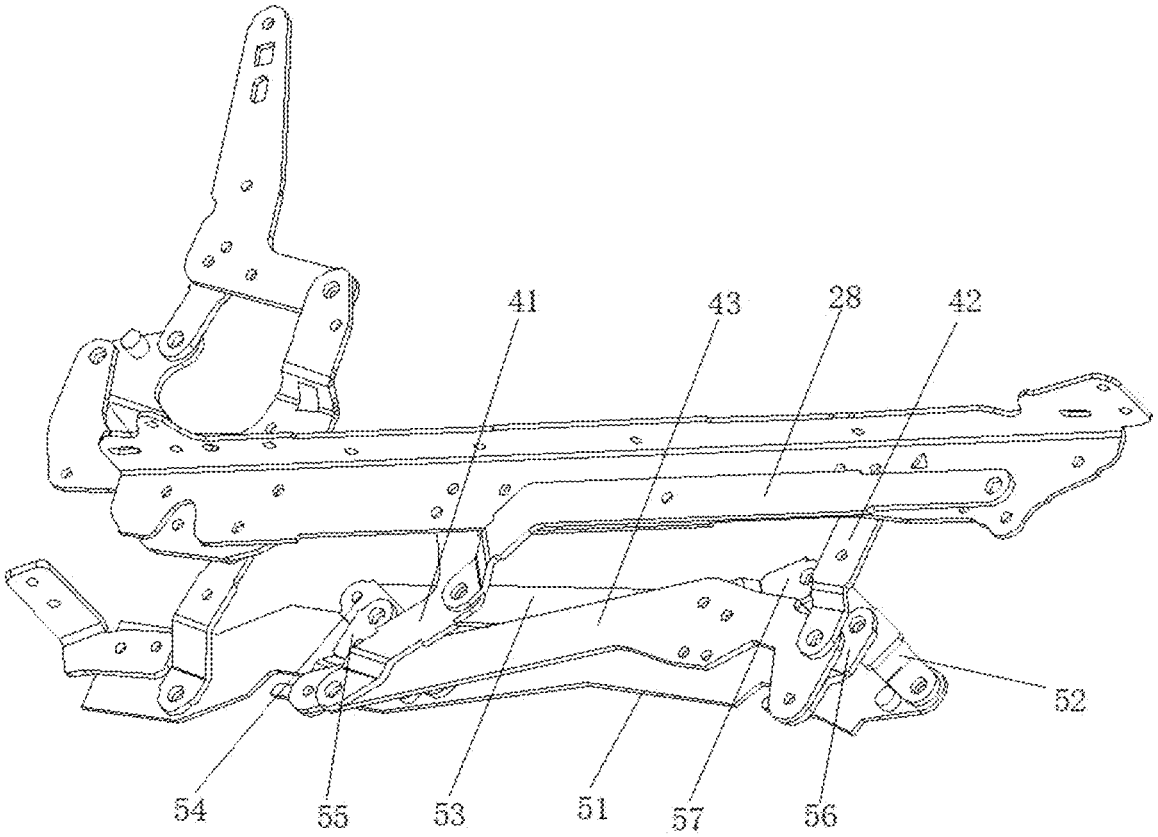
FIG. 8 is a schematic of the mating between a seat unit, a backrest unit, a link structure, and a control structure, which shows that a mechanical extension device is in a state for a sitting posture.
Figure 9:
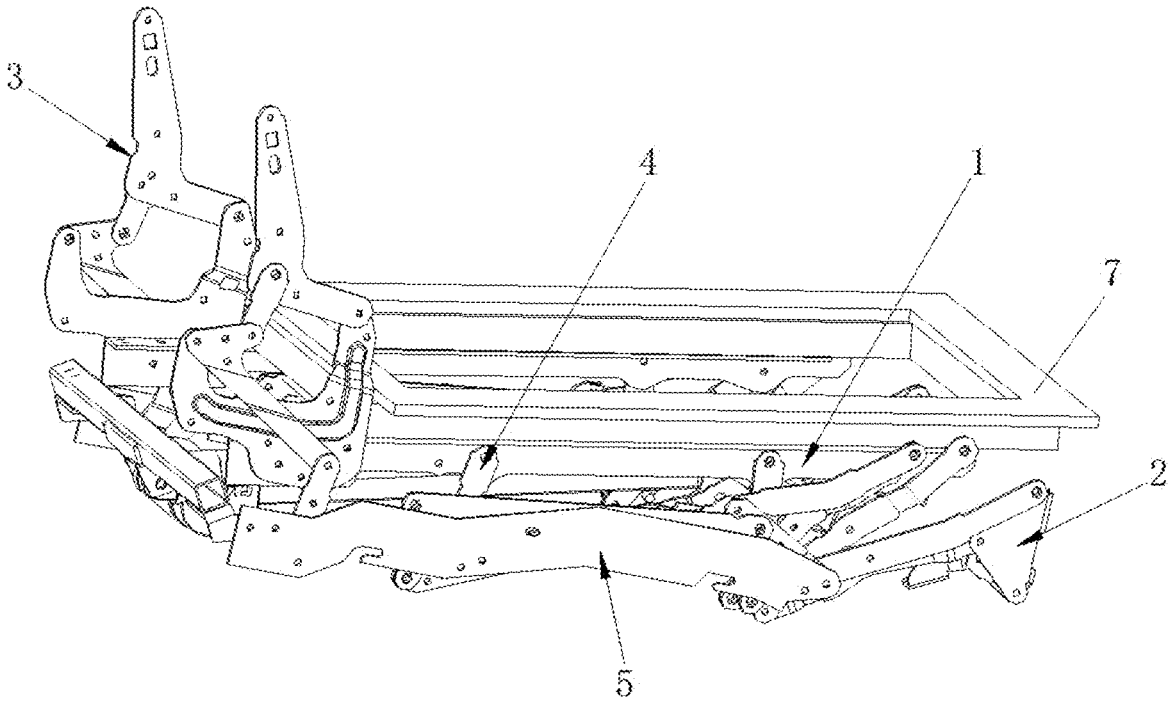
FIG. 9 is perspective view one of a mechanical extension device in embodiment two of the present application, which shows that the mechanical extension device is in a state for a sitting posture.
Figure 10:
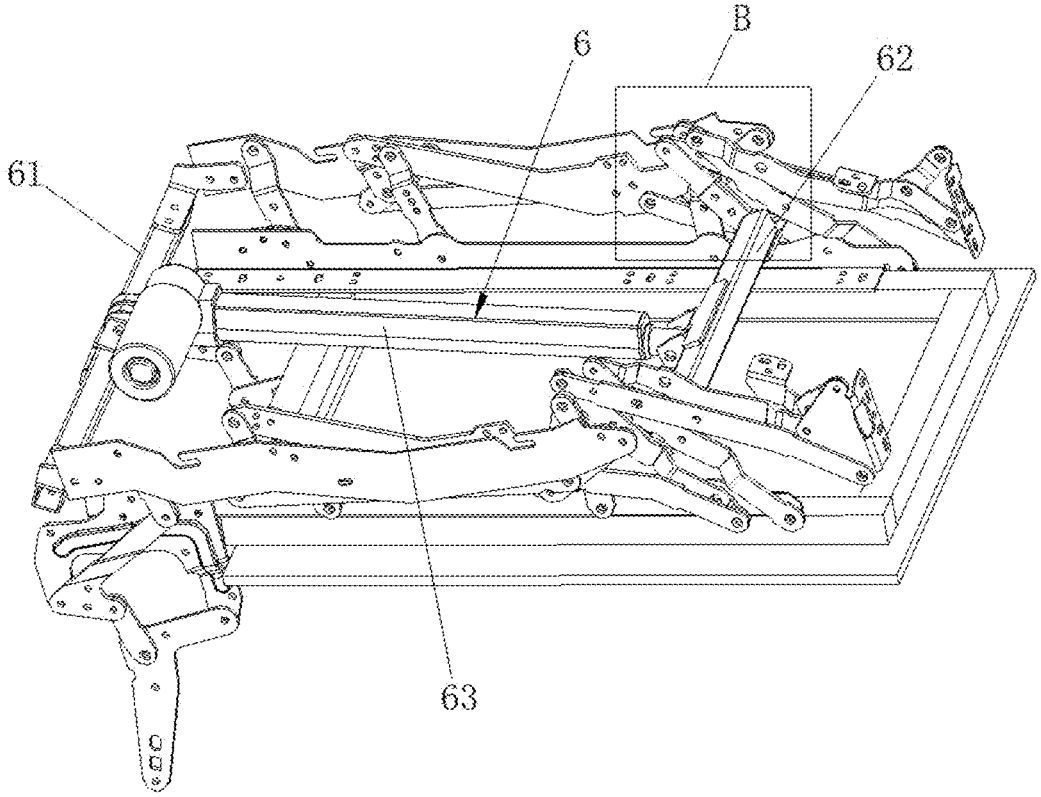
FIG. 10 is perspective view two of a mechanical extension device in embodiment two of the present application, which shows that the mechanical extension device is in a state for a sitting posture.

The link structure 4 in this embodiment connects to the mounting plate 11. As shown in FIG. 6, the link structure 4 includes a first link 41, a second link 42, and a third link 43, where a first end of the first link 41 hinges to the mounting plate 11, and a second end of the first link 41 hinges to the third link 43; a first end of the second link 42 hinges to the mounting plate 11, and a second end of the second link 42 hinges to the third link 43. A hinge point between the first link 41 and the third link 43 and a hinge point between the second link 42 and the third link 43 are located at two ends of the third link 43 separately, and the first link 41, the second link 42, the third link 43, and the mounting plate 11 form a first four-bar structure. The first link 41 in this embodiment is substantially L-shaped and thus has better structural strength, and the link structure 4 operates more smoothly. The backrest unit 3 in this embodiment is disposed on the mounting plate 11. As shown in FIG. 6, the backrest unit 3 includes a fixed plate 31, a first backrest adjustment rod 32, a second backrest adjustment rod 33, a third backrest adjustment rod 34, and a fourth backrest adjustment rod 35, where the fixed plate 31 is fixed to the mounting plate 11, a first end of the first backrest adjustment rod 32 is provided with a mounting portion 321 for mounting a backrest, a second end of the first backrest adjustment rod 32 hinges to the fixed plate 31, and when the first backrest adjustment rod 32 rotates about a hinge point between the first backrest adjustment rod 32 and the fixed plate 31, an angle of the mounting portion 321 may be adjusted. As shown in FIG. 7, the third backrest adjustment rod 34 hinges to the fixed plate 31 and has a first arm 341 and a second arm 342; a first end of the second backrest adjustment rod 33 hinges to the first backrest adjustment rod 32, and a second end of the second backrest adjustment rod 33 hinges to the first arm 341 of the third backrest adjustment rod 34; the second arm 342 of the third backrest adjustment rod 34 hinges to a first end of the fourth backrest adjustment rod 35; and a second end of the fourth backrest adjustment rod 35 hinges to a first control link 51, so as to achieve linkage between the control structure 5 and the backrest unit 3.

As shown in FIG. 6, the fixed plate 31 in this embodiment is U-shaped. In an embodiment, the fixed plate 31 includes a body portion 311, a first support arm 312, and a second support arm 313, the first backrest adjustment rod 32 hinges to the first support arm 312, and the third backrest adjustment rod 34 hinges to the second support arm 313. As shown in FIG. 7, a stiffener 314 is disposed on the fixed plate 31, and the stiffener 314 is disposed on the body portion 311 and extends to at least the first support arm 312. In an embodiment, the stiffener 314 extends to the second support arm 313. During use, the first support arm 312 bears the weight of a reclining user. Thus, the arrangement of the stiffener 314 can increase the weight that the backrest unit 3 can bear, thereby improving structural strength.

The control structure 5 in this embodiment connects to the link structure 4. As shown in FIGS. 5 to 8, the control structure 5 includes the first control link 51, a second control link 52, a third control link 53, a fourth control link 54, a fifth control link 55, a sixth control link 56, and a seventh control link 57; where a first end of the second control link 52 hinges to the first control link 51, and a second end of the second control link 52 hinges to the third control link 53 (referring to a position relationship in FIG. 8); a first end of the fourth control link 54 hinges to the first control link 51, and a second end of the fourth control link 54 hinges to the third control link 53; and the first control link 51, the second control link 52, the third control link 53, and the fourth control link 54 constitute a second four-bar structure. The control structure 5 in this embodiment connects to the link structure 4, so as to achieve linkage. In an embodiment, a first end of the fifth control link 55 hinges to the fourth control link 54 (hinging to an intermediate position of the fourth control link 54), and a second end of the fifth control link 55 hinges to the third link 43; a first end of the sixth control link 56 hinges to the second control link 52 (hinging to an intermediate position of the second control link 52), and a second end of the sixth control link 56 hinges to the third link 43 (referring to a position relationship in FIG. 8); and a first end of the seventh control link 57 hinges to an end of the second control link 52, and a second end of the seventh control link 57 hinges to the third link 43 (referring to a position relationship in FIGS. 7 and 8). In this manner, linkage between the control structure 5 and the link structure 4 is achieved.

As shown in FIG. 7, in this embodiment, a hinge point between the seventh control link 57 and the second control link 52, a hinge point between the third control link 53 and the second control link 52, a hinge point between the sixth control link 56 and the second control link 52, and a hinge point between the first control link 51 and the second control link 52 are arranged in sequence in a length direction of the second control link 52, and the hinge point between the seventh control link 57 and the second control link 52 and the hinge point between the first control link 51 and the second control link 52 are located at two ends of the second control link 52 in the length direction.

Figure 5:
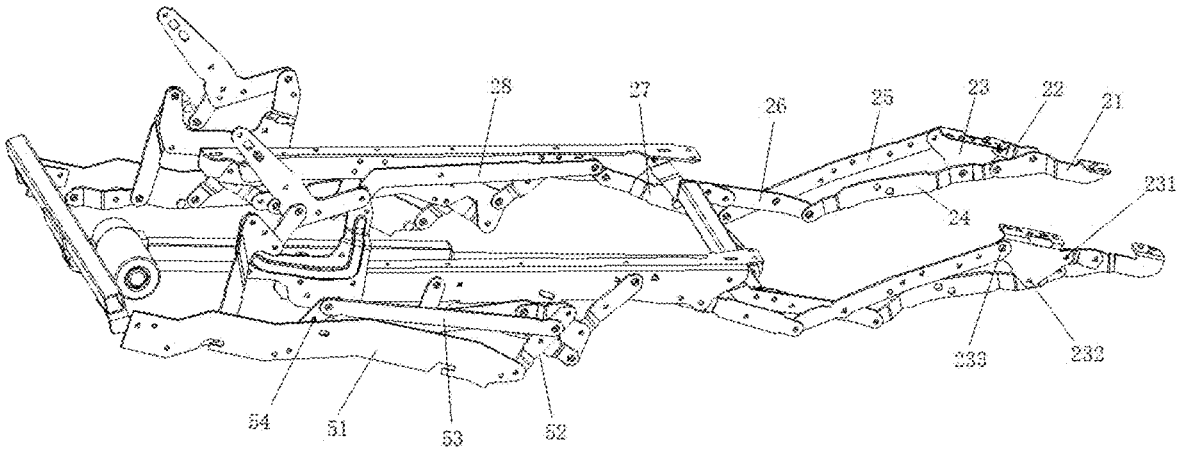
FIG. 5 is a perspective view of a mechanical extension device in embodiment one of the present application, which shows that the mechanical extension device is in a state for a lying posture.

As shown in FIG. 5, the leg unit 2 in this embodiment connects to the mounting plate 11. The leg unit 2 includes a first leg adjustment rod 21, a second leg adjustment rod 22, a third leg adjustment rod 23, a fourth leg adjustment rod 24, a fifth leg adjustment rod 25, a sixth leg adjustment rod 26, and a seventh leg adjustment rod 27.

In this embodiment, an end of the first leg adjustment rod 21 hinges to a first end of the fourth leg adjustment rod 24, and an intermediate position of the first leg adjustment rod 21 hinges to the second leg adjustment rod 22.

The third leg adjustment rod 23 is substantially triangular, and the third leg adjustment rod 23 has a first hinge point 231, a second hinge point 232, and a third hinge point 233 at its three corners, where a mounting plane for mounting a soft leg support part is provided along a line between the first hinge point 231 and the third hinge point 233, an end of the second leg adjustment rod 22 hinges to the first hinge point 231 of the third leg adjustment rod 23, an intermediate position of the fourth leg adjustment rod 24 hinges to the second hinge point 232 of the third leg adjustment rod 23, and a second end of the fourth leg adjustment rod 24 facing away from the first leg adjustment rod 21 hinges to the sixth leg adjustment rod 26; a first end of the fifth leg adjustment rod 25 hinges to the third hinge point 233 of the third leg adjustment rod 23, and a second end of the fifth leg adjustment rod 25 hinges to the seventh leg adjustment rod 27; the seventh leg adjustment rod 27 hinges to the mounting plate 11; and the sixth leg adjustment rod 26 hinges to the mounting plate 11, and an intermediate position of the sixth leg adjustment rod 26 hinges to an intermediate position of the fifth leg adjustment rod 25.

The leg unit 2 in this embodiment further includes a linkage adjustment rod 28. In an embodiment, as shown in FIG. 6, the linkage adjustment rod 28 has a first portion 281 and a second portion 282, where an end of the first portion 281 hinges to the seventh leg adjustment rod 27, and an end of the second portion 282 hinges to the first link 41. When the seventh leg adjustment rod 27 moves, the linkage adjustment rod 28 may be driven to rotate, so as to control linkage between the link structure 4 and the leg unit 2. The first portion 281 and the second portion 282 are at an angle that is an obtuse angle. In an embodiment, the angle is 100° to 135°. In this manner, the linkage adjustment rod 28 operates more smoothly during linkage.

Figure 2:
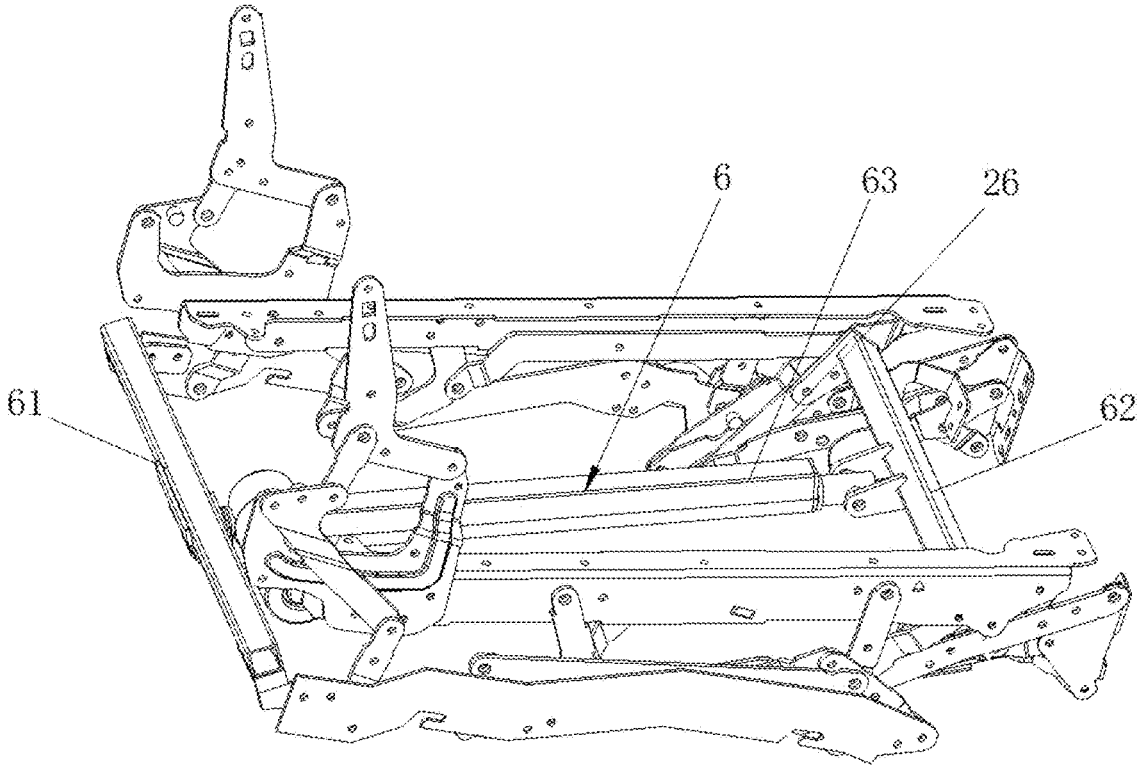
FIG. 2 is a perspective view of a mechanical extension device in embodiment one of the present application, which shows that the mechanical extension device is in a state for a sitting posture.

The drive unit 6 in this embodiment connects to the control structure 5 and the leg unit 2 separately. In an embodiment, as shown in FIG. 2, the drive unit 6 includes a first bracket 61, a second bracket 62, and a telescopic unit 63, where two ends of the telescopic unit 63 connect to the first bracket 61 and the second bracket 62 separately to adjust the distance between the first bracket 61 and the second bracket 62. The drive unit 6 connects to the control structure 5. In an embodiment, the first bracket 61 connects to the first control link 51. The drive unit 6 connects to the leg unit 2. In an embodiment, the second bracket 62 connects to the sixth leg adjustment rod 26. The telescopic unit 63 in this embodiment may be an electric adjustment structure with a cylinder structure, a motor structure, or the like as a body so that the telescopic unit 63 can extend and retract. In other embodiments, the telescopic unit may be adjusted by use of a manual structure.

As shown in FIG. 2, in this embodiment, during state adjustment, the telescopic unit 63 rotates the second bracket 62 forward by an angle to push the sixth leg adjustment rod 26 out.

The mechanical extension device in this embodiment has multiple states to provide different use postures. Specifically, the mechanical extension device has a state for a sitting posture, a state for a leisure posture, and a state for a lying posture.

As shown in FIGS. 1 and 2, the mechanical extension device is in the state for the sitting posture. In this case, the leg unit 2 is in a collapsed state, and the mounting portion 321 of the first backrest adjustment rod 32 is perpendicular or substantially perpendicular to the mounting plate 11 of the seat unit 1.

Figure 3:
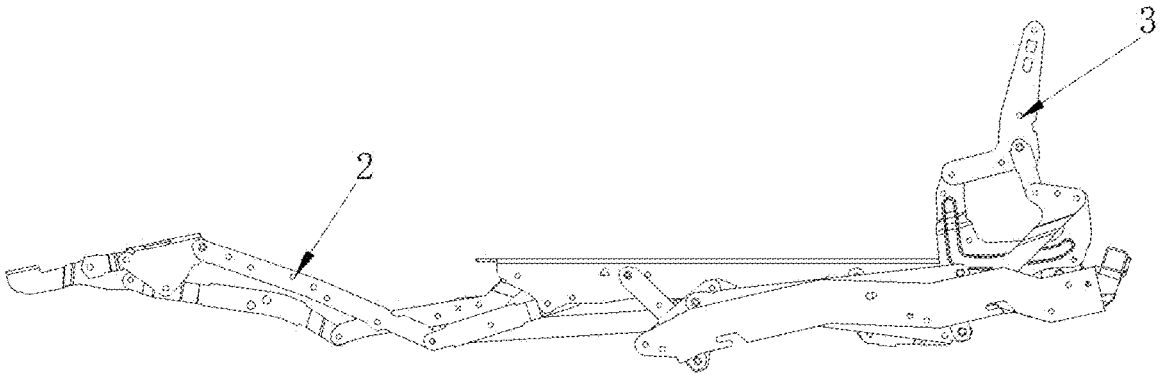
FIG. 3 is a front view of a mechanical extension device in embodiment one of the present application, which shows that the mechanical extension device is in a state for a leisure posture.
Figure 4:
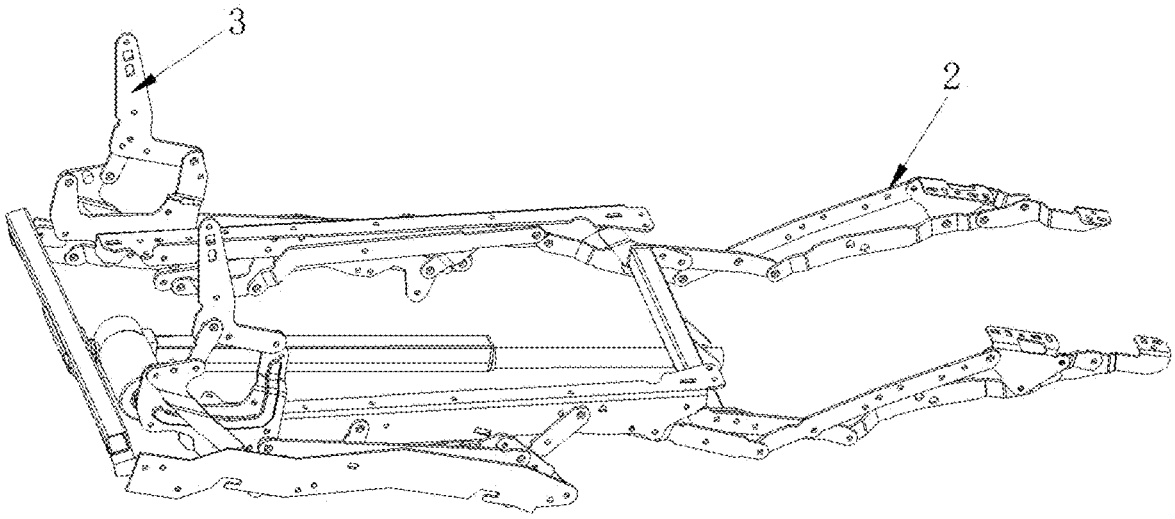
FIG. 4 is a perspective view of a mechanical extension device in embodiment one of the present application, which shows that the mechanical extension device is in a state for a leisure posture.

As shown in FIGS. 3 and 4, the mechanical extension device is in the state for the leisure posture. Relative to the state for the sitting posture, the leg unit 2 is unfolded to support legs.

As shown in FIG. 5, the mechanical extension device is in the state for the lying posture. Relative to the state for the leisure posture, the backrest unit 3 is further reclined (the angle between the mounting portion 321 of the first backrest adjustment rod 32 and the mounting plate 11 of the seat unit 1 increases) so that the user can be in the lying posture.

A control principle of the mechanical extension device in this embodiment is described below. In the state for the sitting posture, the drive unit 6 is in an initial state (the distance between the first bracket 61 and the second bracket 62 is the closest). When the telescopic unit 63 pushes the second bracket 62 and pushes the sixth leg adjustment rod 26 through the second bracket 62, the sixth leg adjustment rod 26 rotates about a hinge point between the sixth leg adjustment rod 26 and the mounting plate 11 to unfold the leg unit 2. When the telescopic unit 63 continues to extend, the first bracket 61 pushes the first control link 51, and the first control link 51 may adjust the angle of the backrest unit 3 (the angle between the mounting portion 321 of the first backrest adjustment rod 32 and the mounting plate 11 of the seat unit 1 increases).

Compared with that in the related art, the mechanical extension device provided in this embodiment has the following advantages or effects: a simple structure and a reasonable design: a seat frame can be adjusted between multiple states simply by one power unit, relatively reducing a cost; the link structure 4 and the control structure 5 are more compact in structure and more reasonable in design and thus are adjusted and operated more smoothly, improving use comfort; and the backrest unit has enhanced structural strength and is not easy to damage during use.

Embodiment Two

Referring to FIGS. 9 to 17, a mechanical extension device in this embodiment is applicable to a sofa, seat, or wheelchair, especially an electric floor sofa with armrests, and the mechanical extension device includes a seat unit 1, a leg unit 2, a backrest unit 3, a link structure 4, a control structure 5, and a drive unit 6. The link structure 4 and the control structure 5 form a suspension mechanism for the mechanical extension device.

Figure 12:
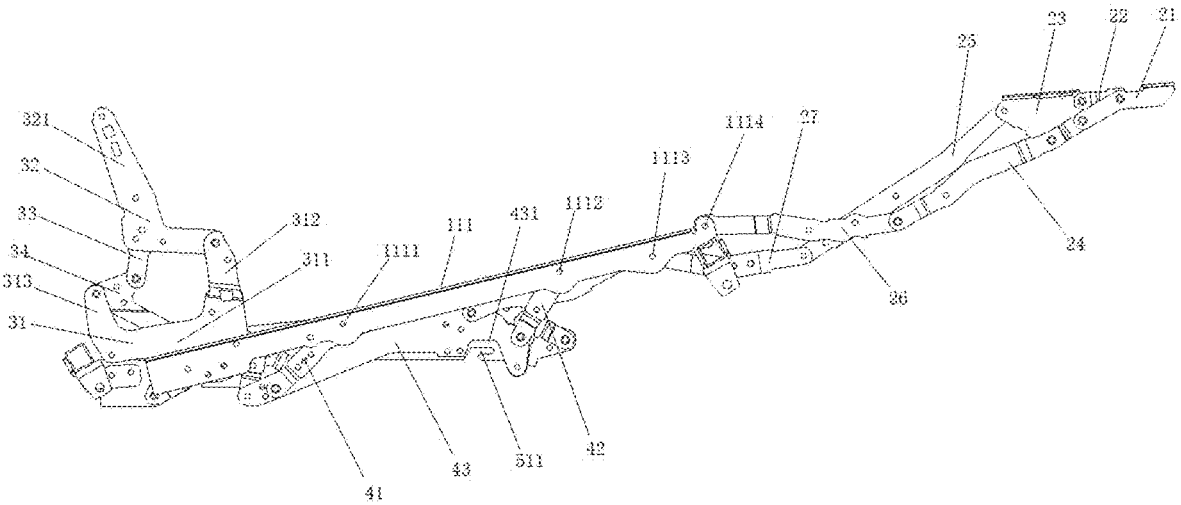
FIG. 12 is a schematic of the mating between a seat unit, a link structure, a leg unit, a backrest unit, and a control structure, which shows a state for a leisure posture.

The seat unit 1 in this embodiment includes a mounting plate 11. As shown in FIG. 12, an upper portion of the mounting plate 11 is configured with a mounting plane 111, and the mounting plate 11 is bent so that the mounting plane 111 is formed directly and used for mounting a wooden frame 7. In an embodiment, the wooden frame 7 may be placed directly on the mounting plane 111 and fixed. When the mechanical extension device is mounted to any one of the sofa, seat, or wheelchair, and any one of the sofa, seat, or wheelchair is placed on a horizontal plane, the angle between the mounting plane and the horizontal plane is 5° to 10°.

Figure 11:
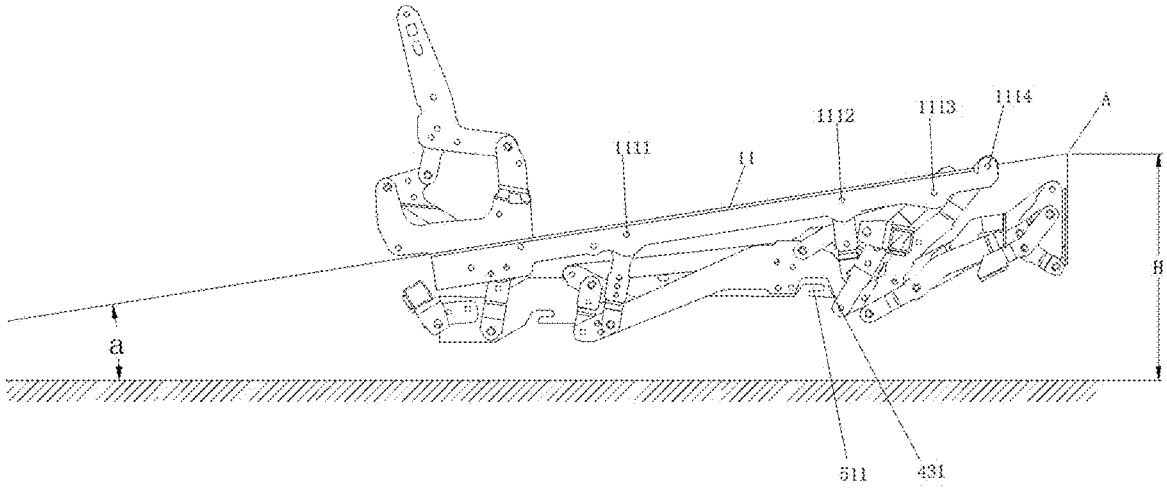
FIG. 11 is a schematic of the mating between a seat unit, a link structure, a leg unit, a backrest unit, and a control structure, which shows a state for a sitting posture.

As shown in FIG. 11, the link structure 4 (suspension mechanism) in this embodiment connects to the mounting plate 11 through a first rivet point 1111 and a second rivet point 1112 on the mounting plate 11. The leg unit 2 in this embodiment connects to the mounting plate 11 through a third rivet point 1113 and a fourth rivet point 1114 on the mounting plate 11. As shown in FIG. 11, during use, the first rivet point 1111, the second rivet point 1112, and the third rivet point 1113 are each below the mounting plane 111.

In some embodiments, when the mechanical extension device is in use, a vertical distance between each of the first rivet point 1111, the second rivet point 1112, the third rivet point 1113, and the fourth rivet point 1114 and the mounting plane 111 of the mounting plate 11 (or an extension line of the mounting plane 111) is not greater than 20 mm. In some embodiments, when the mechanical extension device is in use, the vertical distance between the fourth rivet point 1114 and the extension line of the mounting plane 111 of the mounting plate 11 is not greater than 10 mm. In some embodiments, when the mechanical extension device is in use, the center of the fourth rivet point 1114 is above the mounting plane 111, and a vertical distance between the center of the fourth rivet point 1114 and the extension line of the mounting plane 111 of the mounting plate 11 is not greater than 1 mm.

In some embodiments, when the mechanical extension device is in use, the fourth rivet point 1114 is within 10 mm above the mounting plane 111 or within 10 mm above the extension line in a length direction. In some embodiments, when the mechanical extension device is in use, the fourth rivet point 1114 is within 1 mm above the mounting plane 111 or within 1 mm above the extension line in the length direction. In some other embodiments, when the mechanical extension device is in use, the fourth rivet point 1114 is not lower than the mounting plane 111 in an extension direction of the length of the mounting plane 111, that is, a projection of the fourth rivet point 1114 along the length direction of the mounting plane 111 overlaps or is no more than 1 mm higher than a projection of the mounting plane 111 along the length direction of the mounting plane 111. The distance in this embodiment refers to a vertical distance from the central point or the center of a rivet point to the mounting plane 111 or the extension line of the mounting plane 111.

As shown in FIG. 11, in this embodiment, in a state for a sitting posture, an intersection between the extension line of the mounting plane 111 and an extension line of the outer side of the leg unit 2 is A; when the mechanical extension device is in use, the intersection A has a distance H of 255 mm to 264 mm from the ground.

Figure 13:
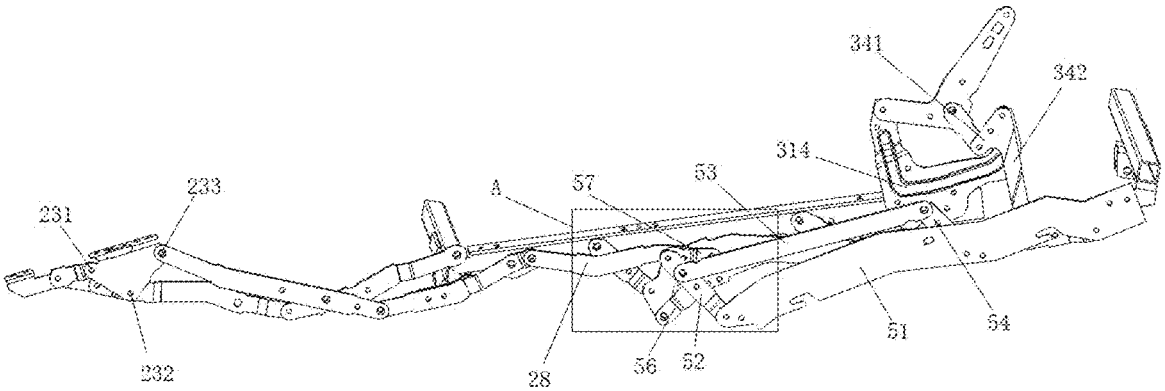
FIG. 13 is schematic one of the mating between a seat unit, a link structure, a leg unit, a backrest unit, and a control structure, which shows a state for a lying posture.

The link structure 4 in this embodiment connects to the mounting plate 11. As shown in FIG. 12, the link structure 4 includes a first link 41, a second link 42, and a third link 43, and the suspension mechanism connects to and applied to the mechanical extension device through the first link 41 and the second link 42. A first end of the first link 41 hinges to the mounting plate 11. In an embodiment, the first end of the first link 41 hinges to the first rivet point 1111 of the mounting plate 11. Further, the first end of the first link 41 directly hinges to the first rivet point 1111 of the mounting plate 11 through a rivet, the first rivet point 1111 is below the mounting plane 111, and the vertical distance between the first rivet point 1111 and the mounting plane 111 is less than 20 mm, 15 mm, or 13 mm. A second end of the first link 41 hinges to the third link 43. A first end of the second link 42 hinges to the mounting plate 11. In an embodiment, the first end of the second link 42 hinges to the second rivet point 1112 of the mounting plate 11. Further, the first end of the second link 42 directly hinges to the second rivet point 1112 of the mounting plate 11 through a rivet, and the vertical distance between the second rivet point 1112 and the mounting plane 111 is less than 20 mm, 15 mm, or 13 mm. A second end of the second link 42 hinges to the third link 43. A hinge point between the first link 41 and the third link 43 and a hinge point between the second link 42 and the third link 43 are located at two ends of the third link 43 separately. As shown in FIG. 13, the leg unit 2 in this embodiment further includes a linkage adjustment rod 28, and the linkage adjustment rod 28 connects to the link structure 4, so as to achieve linkage between the link structure 4 and the leg unit 2. The first link 41 in this embodiment is substantially linear.

In this embodiment, the first link 41, the second link 42, the third link 43, and the mechanical extension device (the mounting plate 11) connecting thereto form a first four-bar structure.

The backrest unit 3 in this embodiment is disposed on the mounting plate 11. The backrest unit 3 includes a fixed plate 31, a first backrest adjustment rod 32, a second backrest adjustment rod 33, a third backrest adjustment rod 34, and a fourth backrest adjustment rod 35, where the fixed plate 31 is fixed to the mounting plate 11, the first backrest adjustment rod 32 has a mounting portion 321 for mounting a backrest, an end of the first backrest adjustment rod 32 hinges to the fixed plate 31, and when the first backrest adjustment rod 32 rotates about a hinge point between the first backrest adjustment rod 32 and the fixed plate 31, an angle of the mounting portion 321 may be adjusted; the third backrest adjustment rod 34 hinges to the fixed plate 31 and has a first arm 341 and a second arm 342; a first end of the second backrest adjustment rod 33 hinges to the first backrest adjustment rod 32, and a second end of the second backrest adjustment rod 33 hinges to the first arm 341 of the third backrest adjustment rod 34; the second arm 342 of the third backrest adjustment rod 34 hinges to the fourth backrest adjustment rod 35; and the fourth backrest adjustment rod 35 connects to the control structure 5, so as to achieve linkage between the control structure 5 and the backrest unit 3.

The fixed plate 31 in this embodiment is U-shaped. In an embodiment, the fixed plate 31 includes a body portion 311, a first support arm 312, and a second support arm 313, the first backrest adjustment rod 32 hinges to the first support arm 312, and the third backrest adjustment rod 34 hinges to the second support arm 313. A stiffener 314 is disposed on the fixed plate 31, and the stiffener 314 is disposed on the body portion 311 and extends to at least the first support arm 312. In an embodiment, the stiffener 314 extends to the second support arm 313. During use, the first support arm 312 bears the weight of a reclining user. Thus, the arrangement of the stiffener 314 can increase the weight that the backrest unit 3 can bear, thereby improving structural strength.

Figure 14:
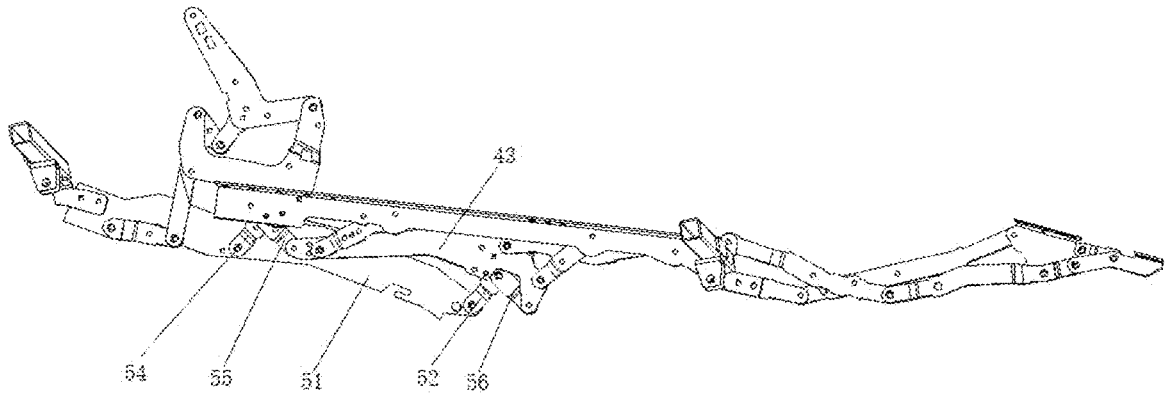
FIG. 14 is schematic two of the mating between a seat unit, a link structure, a leg unit, a backrest unit, and a control structure, which shows a state for a lying posture.

As shown in FIGS. 13 and 14, the control structure 5 in this embodiment includes a first control link 51, a second control link 52, a third control link 53, a fourth control link 54, a fifth control link 55, a sixth control link 56, and a seventh control link 57; where the fourth backrest adjustment rod 35 hinges to the first control link 51, so as to achieve the linkage between the control structure 5 and the backrest unit 3; a first end of the second control link 52 hinges to the first control link 51, and a second end of the second control link 52 hinges to the third control link 53; a first end of the fourth control link 54 hinges to the first control link 51, and a second end of the fourth control link 54 hinges to the third control link 53; and the first control link 51, the second control link 52, the third control link 53, and the fourth control link 54 constitute a second four-bar structure.

Figure 15:
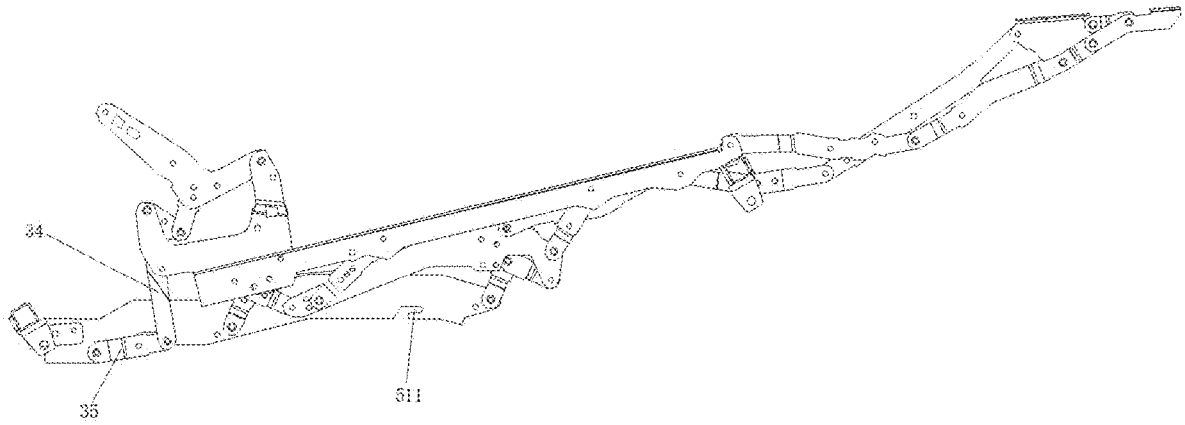
FIG. 15 is schematic three of the mating between a seat unit, a link structure, a leg unit, a backrest unit, and a control structure, which shows a state for a lying posture.
Figure 16:
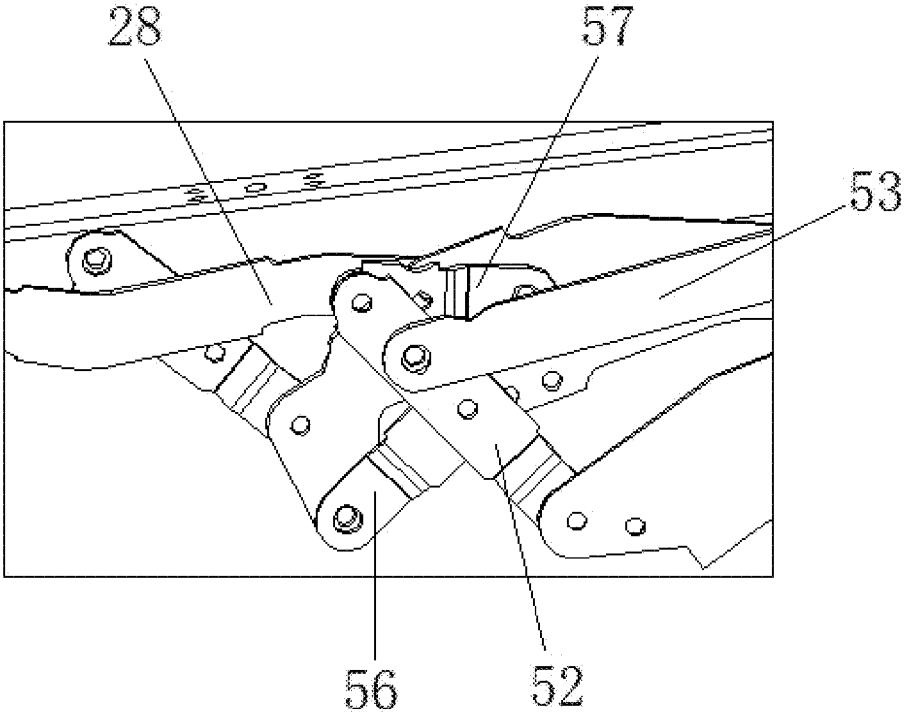
FIG. 16 is an enlarged view of part A in FIG. 13.
Figure 17:
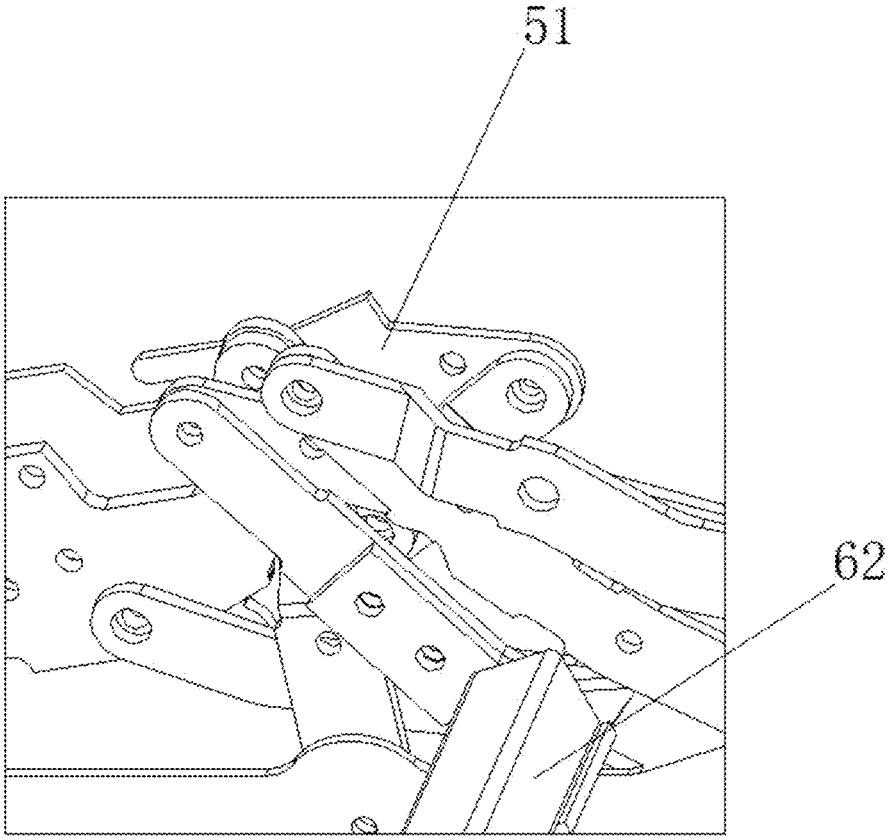
FIG. 17 is an enlarged view of part B in FIG. 10.

As shown in FIG. 15, the first control link 51 in this embodiment is provided with at least one set of avoidance holes 511. Thus, a screw below the first control link 51 is tightened. The third link 43 in this embodiment is provided with a notch 431, and the notch 431 corresponds to the avoidance hole 511, so as to give way.

The control structure 5 in this embodiment connects to the link structure 4, so as to achieve linkage. In an embodiment, a first end of the fifth control link 55 hinges to the fourth control link 54 (hinging to an intermediate position of the fourth control link 54), and a second end of the fifth control link 55 hinges to the third link 43; a first end of the sixth control link 56 hinges to the second control link 52 (hinging to an intermediate position of the second control link 52), and a second end of the sixth control link 56 hinges to the third link 43; and a first end of the seventh control link 57 hinges to the second control link 52, and a second end of the seventh control link 57 hinges to the third link 43. In this manner, linkage between the control structure 5 and the link structure 4 is achieved.

The leg unit 2 in this embodiment connects to the mounting plate 11. The leg unit 2 includes a first leg adjustment rod 21, a second leg adjustment rod 22, a third leg adjustment rod 23, a fourth leg adjustment rod 24, a fifth leg adjustment rod 25, a sixth leg adjustment rod 26, and a seventh leg adjustment rod 27. In this embodiment, an end of the first leg adjustment rod 21 hinges to the fourth leg adjustment rod 24, and an intermediate position of the first leg adjustment rod 21 hinges to the second leg adjustment rod 22; the third leg adjustment rod 23 has a first hinge point 231, a second hinge point 232, and a third hinge point 233, where the first hinge point 231, the second hinge point 232, and the third hinge point 233 are not arranged on the same straight line; an end of the second leg adjustment rod 22 hinges to the first hinge point 231 of the third leg adjustment rod 23, an intermediate position of the fourth leg adjustment rod 24 hinges to the second hinge point 232 of the third leg adjustment rod 23, and a second end of the fourth leg adjustment rod 24 facing away from the first leg adjustment rod 21 hinges to the sixth leg adjustment rod 26; a first end of the fifth leg adjustment rod 25 hinges to the third hinge point 233 of the third leg adjustment rod 23, and a second end of the fifth leg adjustment rod 25 hinges to the seventh leg adjustment rod 27; and the seventh leg adjustment rod 27 hinges to the mounting plate 11. In an embodiment, an end of the seventh leg adjustment rod 27 hinges to the third rivet point 1113 of the mounting plate 11. In an embodiment, an end of the seventh leg adjustment rod 27 directly hinges to the third rivet point 1113 of the mounting plate 11 through a rivet, and the vertical distance between the third rivet point 1113 and the mounting plane 111 is less than 20 mm, 15 mm, or 13 mm. The sixth leg adjustment rod 26 hinges to the mounting plate 11. In an embodiment, an end of the sixth leg adjustment rod 26 hinges to the fourth rivet point 1114 of the mounting plate 11. In an embodiment, an end of the sixth leg adjustment rod 26 directly hinges to the fourth rivet point 1114 of the mounting plate 11 through a rivet, and the vertical distance between the fourth rivet point 1114 and the mounting plane 111 or the extension line of the mounting plane 111 is less than 10 mm.

In an embodiment, the vertical distance between the fourth rivet point 1114 and the mounting plane 111 or the extension line of the mounting plane 111 is less than 1 mm. An intermediate position of the sixth leg adjustment rod 26 hinges to an intermediate position of the fifth leg adjustment rod 25.

In this embodiment, a first end of the linkage adjustment rod 28 hinges to the third link 43, and a second end of the linkage adjustment rod 28 hinges to the seventh leg adjustment rod 27. When the linkage adjustment rod 28 rotates, the linkage between the leg unit 2 and the link structure 4 can be controlled.

The drive unit 6 in this embodiment connects to the control structure 5 and the leg unit 2 separately. In an embodiment, the drive unit 6 includes a first bracket 61, a second bracket 62, and a telescopic unit 63, where two ends of the telescopic unit 63 connect to the first bracket 61 and the second bracket 62 separately to adjust the distance between the first bracket 61 and the second bracket 62. The drive unit 6 connects to the control structure 5. In an embodiment, the first bracket 61 connects to the first control link 51. The drive unit 6 connects to the leg unit 2. Specifically, the second bracket 62 connects to the seventh leg adjustment rod 27. The telescopic unit 63 in this embodiment may be an electric adjustment structure with a cylinder structure, a motor structure, or the like as a body so that the telescopic unit 63 can extend and retract.

The mechanical extension device in this embodiment has multiple states in use to provide different use postures. Specifically, the mechanical extension device has the state for the sitting posture, a state for a leisure posture, and a state for a lying posture.

As shown in FIGS. 9 to 12, the mechanical extension device is in the state for the sitting posture. In this case, the leg unit 2 is in a collapsed state, and the mounting portion 321 of the first backrest adjustment rod 32 is perpendicular or substantially perpendicular to the mounting plate 11 of the seat unit 1.

As shown in FIG. 12, the mechanical extension device is in the state for the leisure posture. Relative to the state for the sitting posture, the leg unit 2 is unfolded to support legs.

As shown in FIGS. 13 to 15, the mechanical extension device is in the state for the lying posture. Relative to the state for the leisure posture, the backrest unit 3 is further reclined (the angle between the mounting portion 321 of the first backrest adjustment rod 32 and the mounting plate 11 of the seat unit 1 increases) so that the user is in the lying posture.

A control principle of the mechanical extension device in this embodiment is described below. In the state for the sitting posture, the drive unit 6 is in an initial state (the distance between the first bracket 61 and the second bracket 62 is the closest). When the telescopic unit 63 pushes the second bracket 62 and pushes the seventh leg adjustment rod 27 through the second bracket 62, the seventh leg adjustment rod 27 rotates about a hinge point between the seventh leg adjustment rod 27 and the mounting plate 11 to unfold the leg unit 2. When the telescopic unit 63 continues to extend, the first bracket 61 pushes the first control link 51, and the first control link 51 may adjust the angle of the backrest unit 3.

In the present application, the link structure 4 and the control structure 5 are compact in structure and reasonable in design and thus are adjusted and operated more smoothly, improving use comfort; the backrest unit 3 has enhanced structural strength and is not easy to damage during use; and the vertical distance between the fourth rivet point 1114 and the extension line of the mounting plane 111 is not greater than 10 mm. In an embodiment, the vertical distance between the fourth rivet point 1114 and the extension line of the mounting plane 111 is not greater than 1 mm, thereby reducing the height of the mounting plane and reducing the thickness of the mechanical extension device.

Compared with that in the related art, the mechanical extension device provided in the present application has the following advantages or effects: a simple structure and a reasonable design; a seat frame can be adjusted between multiple states simply by one power unit, relatively reducing a cost; the link structure 4 and the control structure 5 are more compact in structure and more reasonable in design so that the mechanical extension device is adjusted and operated more smoothly, improving the use comfort; the backrest unit 3 has the enhanced structural strength and is not easy to damage during use; the arrangement of the first rivet point 1111, the second rivet point 1112, the third rivet point 1113, and the fourth rivet point 1114 in position can reduce the overall height of the sofa and satisfy the requirement for reducing a sitting height of the sofa. Further, the overall thickness of the mechanical extension device can be reduced, that is, with the sitting height unchanged, space at the bottom of the sofa can be increased so that the mechanical extension device can be further applied to a high sofa or a storage function sofa. The wooden frame can be directly mounted on the mounting plane, and no interstice exists between the wooden frame and a side edge of the mounting plate, achieving better stability and more convenience of installation.

What is claimed is:

1. A suspension mechanism, comprising:

a link structure configured to connect to a mounting plate and comprising a first link, a second link, and a third link, wherein a first end of the first link is configured to hinge to the mounting plate, and a second end of the first link hinges to the third link; a first end of the second link is configured to hinge to the mounting plate, and a second end of the second link hinges to the third link; and the first link, the second link, the third link, and the mounting plate are configured to constitute a first four-bar structure; and a control structure connecting to the link structure and comprising a first control link, a second control link, a third control link, and a fourth control link; wherein a first end of the second control link hinges to the first control link, and a second end of the second control link hinges to the third control link; a first end of the fourth control link hinges to the first control link, and a second end of the fourth control link hinges to the third control link; and the first control link, the second control link, the third control link, and the fourth control link constitute a second four-bar structure;

wherein the control structure further comprises a fifth control link, a sixth control link, and a seventh control link; wherein a first end of the fifth control link hinges to the fourth control link, and a second end of the fifth control link hinges to the third link; a first end of the sixth control link hinges to the second control link, and a second end of the sixth control link hinges to the third link; and a first end of the seventh control link hinges to an end of the second control link, and a second end of the seventh control link hinges to the third link.

2. A mechanical extension device, comprising the suspension mechanism according to claim 1 and a seat unit, wherein the seat unit comprises the mounting plate and a mounting plane, and the mounting plate is configured for mounting the suspension mechanism.

3. The mechanical extension device according to claim 2, further comprising a backrest unit, wherein the backrest unit comprises a fixed plate, a first backrest adjustment rod, a second backrest adjustment rod, a third backrest adjustment rod, and a fourth backrest adjustment rod, wherein the fixed plate is fixed to the mounting plate, and an end of the first backrest adjustment rod hinges to the fixed plate; the third backrest adjustment rod hinges to the fixed plate and has a first arm and a second arm; a first end of the second backrest adjustment rod hinges to the first backrest adjustment rod, and a second end of the second backrest adjustment rod hinges to the first arm of the third backrest adjustment rod; the second arm of the third backrest adjustment rod hinges to an end of the fourth backrest adjustment rod; and a second end of the fourth backrest adjustment rod hinges to the first control link.

4. The mechanical extension device according to claim 3, wherein the fixed plate comprises a body portion, a first support arm, and a second support arm, the first backrest adjustment rod hinges to the first support arm, the third backrest adjustment rod hinges to the second support arm, and a stiffener is disposed on the fixed plate.

5. The mechanical extension device according to claim 3, further comprising a leg unit, wherein the leg unit comprises a first leg adjustment rod, a second leg adjustment rod, a third leg adjustment rod, a fourth leg adjustment rod, a fifth leg adjustment rod, a sixth leg adjustment rod, and a seventh leg adjustment rod; wherein an end of the first leg adjustment rod hinges to the fourth leg adjustment rod, and an intermediate position of the first leg adjustment rod hinges to the second leg adjustment rod; the third leg adjustment rod has a first hinge point, a second hinge point, and a third hinge point, an end of the second leg adjustment rod hinges to the first hinge point of the third leg adjustment rod, the fourth leg adjustment rod hinges to the second hinge point of the third leg adjustment rod, and a second end of the fourth leg adjustment rod facing away from the first leg adjustment rod hinges to the sixth leg adjustment rod; a first end of the fifth leg adjustment rod hinges to the third hinge point of the third leg adjustment rod, and a second end of the fifth leg adjustment rod hinges to the seventh leg adjustment rod; the seventh leg adjustment rod hinges to the mounting plate; and the sixth leg adjustment rod hinges to the mounting plate, and an intermediate position of the sixth leg adjustment rod hinges to an intermediate position of the fifth leg adjustment rod.

6. The mechanical extension device according to claim 5, wherein the leg unit further comprises a linkage adjustment rod, wherein a first end of the linkage adjustment rod hinges to the first link, and a second end of the linkage adjustment rod hinges to the seventh leg adjustment rod;

wherein the linkage adjustment rod has a first portion and a second portion, wherein an end of the first portion hinges to the seventh leg adjustment rod, an end of the second portion hinges to the first link, and the first portion and the second portion are at a preset angle that is an obtuse angle.

7. The mechanical extension device according to claim 2, further comprising a drive unit, wherein the drive unit comprises a first bracket, a second bracket, and a telescopic unit, wherein two ends of the telescopic unit connect to the first bracket and the second bracket separately; the first bracket connects to the first control link; and the second bracket connects to a sixth leg adjustment rod, and the telescopic unit is configured to rotate the second bracket forward by an angle to push the sixth leg adjustment rod out.

8. The mechanical extension device according to claim 2, wherein the first link is L-shaped.

9. A mechanical extension device, comprising:

a seat unit comprising a mounting plate, wherein the mounting plate is configured with a mounting plane and has a first rivet point, a second rivet point, a third rivet point, and a fourth rivet point;

a link structure configured to connect to the mounting plate through the first rivet point and the second rivet point on the mounting plate; and a leg unit configured to connect to the mounting plate through the third rivet point and the fourth rivet point on the mounting plate;

wherein the first rivet point, the second rivet point, and the third rivet point are each below the mounting plane; and a distance between a center of the fourth rivet point and an extension line of the mounting plane of the mounting plate in a direction perpendicular to the extension line of the mounting plane is not greater than 10 mm;

wherein the link structure comprises a first link, a second link, and a third link, wherein a first end of the first link hinges to the first rivet point of the mounting plate, and a second end of the first link hinges to the third link; a first end of the second link hinges to the second rivet point of the mounting plate, and a second end of the second link hinges to the third link; and the first link, the second link the third link and the mounting late constitute a first four-bar structure;

the mechanical extension device further comprises a control structure, wherein the control structure comprises a first control link, a second control link, a third control link, and a fourth control link; wherein a first end of the second control link hinges to the first control link, and a second end of the second control link hinges to the third control link; a first end of the fourth control link hinges to the first control link, and a second end of the fourth control link hinges to the third control link; and the first control link the second control link the third control link and the fourth control link constitute a second four-bar structure;

wherein the control structure further comprises a fifth control link, a sixth control link, and a seventh control link; wherein a first end of the fifth control link hinges to the fourth control link and a second end of the fifth control link hinges to the third link; a first end of the sixth control link hinges to the second control link, and a second end of the sixth control link hinges to the third link; and a first end of the seventh control link hinges to an end of the second control link, and a second end of the seventh control link hinges to the third link.

10. The mechanical extension device according to claim 9, wherein the center of the fourth rivet point is above the mounting plane, and the distance between the center of the fourth rivet point and the extension line of the mounting plane of the mounting plate in the direction perpendicular to the extension line of the mounting plane is not greater than 1 mm.

11. The mechanical extension device according to claim 9, further comprising a backrest unit, wherein the backrest unit comprises a fixed plate, a first backrest adjustment rod, a second backrest adjustment rod, a third backrest adjustment rod, and a fourth backrest adjustment rod, wherein the fixed plate is fixed to the mounting plate, and an end of the first backrest adjustment rod hinges to the fixed plate; the third backrest adjustment rod hinges to the fixed plate and has a first arm and a second arm; a first end of the second backrest adjustment rod hinges to the first backrest adjustment rod, and a second end of the second backrest adjustment rod hinges to the first arm of the third backrest adjustment rod; and the second arm of the third backrest adjustment rod hinges to the fourth backrest adjustment rod, and the fourth backrest adjustment rod hinges to the first control link.

12. The mechanical extension device according to claim 9, wherein the leg unit comprises a first leg adjustment rod, a second leg adjustment rod, a third leg adjustment rod, a fourth leg adjustment rod, a fifth leg adjustment rod, a sixth leg adjustment rod, and a seventh leg adjustment rod; wherein an end of the first leg adjustment rod hinges to a first end of the fourth leg adjustment rod, and an intermediate position of the first leg adjustment rod hinges to the second leg adjustment rod; the third leg adjustment rod has a first hinge point, a second hinge point, and a third hinge point, an end of the second leg adjustment rod hinges to the first hinge point of the third leg adjustment rod, the fourth leg adjustment rod hinges to the second hinge point of the third leg adjustment rod, and a second end of the fourth leg adjustment rod facing away from the first leg adjustment rod hinges to the sixth leg adjustment rod; a first end of the fifth leg adjustment rod hinges to the third hinge point of the third leg adjustment rod, and a second end of the fifth leg adjustment rod hinges to the seventh leg adjustment rod; an end of the seventh leg adjustment rod hinges to the third rivet point of the mounting plate; and an end of the sixth leg adjustment rod hinges to the fourth rivet point of the mounting plate, and an intermediate position of the sixth leg adjustment rod hinges to an intermediate position of the fifth leg adjustment rod.

13. The mechanical extension device according to claim 12, wherein the leg unit further comprises a linkage adjustment rod, wherein a first end of the linkage adjustment rod hinges to the third link, and a second end of the linkage adjustment rod hinges to the seventh leg adjustment rod.

14. The mechanical extension device according to claim 9, further comprising a drive unit, wherein the drive unit comprises a first bracket, a second bracket, and a telescopic unit, wherein two ends of the telescopic unit connect to the first bracket and the second bracket separately; the first bracket connects to the first control link; and the second bracket connects to a seventh leg adjustment rod.

15. The mechanical extension device according to claim 9, wherein when the mechanical extension device is in a state for a sitting posture, an intersection A between the extension line of the mounting plane and an extension line of an outer side of the leg unit has a distance of 255 mm to 264 mm from a ground.

16. The mechanical extension device according to claim 9, wherein when the mechanical extension device is mounted to any one of a sofa, a seat, or a wheelchair, and any one of the sofa, the seat, or the wheelchair is placed on a horizontal plane, an angle between the mounting plane and the horizontal plane is 5° to 10°.

* * * * *